US006441294B1

(12) United States Patent
Seli

(10) Patent No.: US 6,441,294 B1
(45) Date of Patent: Aug. 27, 2002

(54) TUG-A-WAH

(76) Inventor: John Seli, 2150 Randolph Rd., Mogadore, OH (US) 44260

( * ) Notice: Subject to any disclaimer, the term of this patent is extended or adjusted under 35 U.S.C. 154(b) by 0 days.

(21) Appl. No.: 09/741,294

(22) Filed: Dec. 21, 2000

(51) Int. Cl.[7] ..... G10G 5/00; G10H 1/055
(52) U.S. Cl. ..... 84/737; 84/267; 84/453
(58) Field of Search ..... 84/735–743, 267, 84/327, 453

(56) References Cited

U.S. PATENT DOCUMENTS 5,478,969 A * 12/1995 Cardey, III et al. ..... 84/737 X

* cited by examiner

*Primary Examiner*—Stanley J. Witkowski
(74) *Attorney, Agent, or Firm*—David M. Lowry

(57) ABSTRACT

The instant device provides a method for enhancing the sound of any acoustic/electric guitar and other musical instrument by electronically oscillating and manipulating the sound emitted by the guitar or other instrument. The prior art utilizes a manually activated processor that when used, in conjunction with a guitar and sound amplifying device, is capable of creating a broad range of sounds. The processor has customarily been located upon the floor and is activated by a foot pedal. This presented method replaces the prior art pedal processors and the need to be physically in proximity to the processor to activate the pedal and the processor. It accomplishes this by providing electronic means integral with a guitar strap whereby upward and downward movements of the guitar neck or guitar body activate the electronic means creating variable electronic signals to an amplifier or other amplifying device enabling a wide range of distorted sounds to be emitted from the guitar.

2 Claims, 4 Drawing Sheets

TUG-A-WAH

BACKGROUND OF THE INVENTION

Brief Summary of the Invention

In the musical world, guitars have been a common instrument for hundreds of years. Today, electrical and acoustical guitars are an essential ingredient in many realms of music. Through the years, guitarists have attempted to manipulate the sound of the guitar to create a wide range of sounds to capture an individual style and feel for the music they present. There are many means or methods of accomplishing the foregoing through utilization of a tonal device enabling the creation of variable guitar sounds. This device has customarily been referred to as a "wah-wah box"or, more generally, a class of devices known as "guitar processors"which are utilized while playing the guitar. In usual fashion, guitar processors are in essence an electronic device enabling the oscillation of electronic signals emitted by the electronic guitar. The guitar processor enables broad tonal range and is a stand alone device customarily located between the guitar and an amplifier. The electronic signal from the guitar runs through the processor and then into a common amplifier. The processor sits on the floor and normally contains a button or pedal which is manipulated while upon the floor by the artist's foot during guitar playing. The processor, and the oscillation omitted therefrom, creates a variety of sounds and tones which would not customarily be capable of achievement by a stand alone guitar.

In furtherance of the multiplicity of sounds desired by guitarists, various "wah-wah" pedals and processors have been developed to create a litany of acoustics and sounds. However, with all processors in the prior art, the artist was required to either stand by the "wah-wah" pedal or relocate to it in order to trigger and utilize the pedal or button located thereon to activate it and achieve the desired variety of sounds. This, obviously, places great limitations upon a guitarist in terms of stage presence and style of play.

In order to eliminate and reduce the limitations inherent in the physical location of the processor, the instant invention is presented.

In principal, the instant device provides a means for achieving all of the benefits of a guitar processor absent the physical restraints inherent in the location of the processor. As such, it is the principal object of the within invention to provide a means of providing these broad ranges of sounds customarily realized by a guitar processor but without the requirement either to be physically in contact with, or relocate to, the processor as it rests upon the floor and/or stage.

In furtherance of the principal object of this invention, the within device presents the capability of accomplishing all of the foregoing. Specifically, it presents a method of establishing an electronic device integral with a guitar strap on either the guitar body or guitar neck side of the strap. During play, the artist, in lieu of relocating or utilizing the standard processor pedal, simply either pushes downward or pulls upward on the guitar strap. The electronic device located therein replaces the means of modifying the sound signal normally located within the processor and accomplishes the same function as the prior art processor. Therefore, the manipulation of either the neck or body of the guitar activates the electronic device and creates the variable signals for transference into the electronic portion of a standardized processor located anywhere on the floor. There is now no need for the processor to be in proximity to the artist. Thus, the artist is able to traverse the stage and not adopt a particular style of play in order to activate his processor and accomplish the desired broad range of sounds.

There is a further distinct and apparent object of this invention to provide a device which could be incorporated into any musical instrument held by any artist in which variable sound is required and/or desired.

Further distinct objects shall become apparent by a review of the specification, drawings, and claim of the within invention.

DETAILED DESCRIPTION OF THE INVENTION

Figure 1:
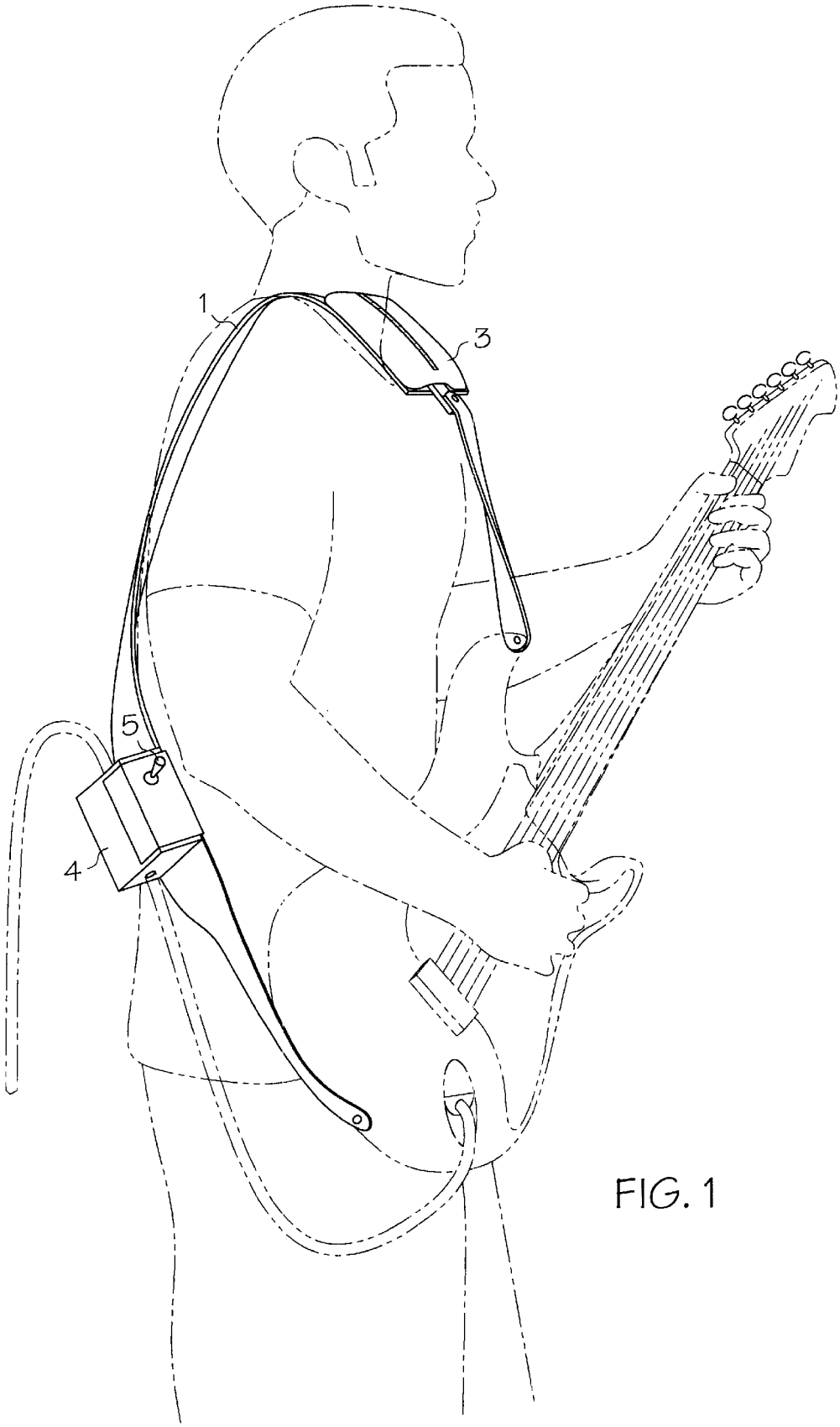
FIG. 1 is a view of a guitarist with guitar strap demonstrating the placement of the electronic device capable of creating variable sounds and as used to manipulate guitar sounds.

FIG. 1 depicts the general nature of the within device. A guitar strap attaches to the body of the guitar as shown. The device is located within and upon the guitar strap. It is capable of being placed on either side of the guitar strap. If located as shown, the guitarist pushes down on the neck of the guitar to activate it. If placed at the other end of the strap, a guitarist would push down on the guitar body to activate the device. Further, the Figure shows the general nature of a standard electric guitar with the guitar power means and the connections as between the device and the power cord of the guitar.

A standard guitar processor contains certain electronics as well as variable electronic means to manipulate the guitar's sound. In the prior art, that is all located within the processor. The processor of prior art was placed upon the floor and/or stage. In order to activate it, the artist would need to physically locate himself to the unit. Thereupon, the artist would use his foot to manipulate a pedal, slide, or button. The processor had what was essentially a variable resistance means triggered by the action of the foot. The variance then was transformed into harmonic distortions through the remainder of the electronic components in the particular processor. This invention essentially removes the variable resistance means of the processor and places it in the guitar strap. Manipulation by a foot, and physical presence and proximately to the processor, is no longer relevant. Therefore, the instant device displaces the variable electronic aspect from the physical constraints of the processor by placing it in the guitar strap.

The variable resistance means is similar to that incorporated into a standard light dimmer switch. The turning of the switch enables a variable source of power thereby distorting the light emitted by a bulb or light source. In essence, this concept is analogous to the desired goal of this device. The variable resistance means located in the guitar strap is activated by pushing the neck or body of the guitar in an upward or downward motion. The device and its standardized rheostat then varies the resistance of the electric circuit without interrupting the circuit. This manipulation of resistance is then transformed by means of the multiplicity of processors capable of purchase on the open market. Each processor and its manufacturer describe the capability to achieve various sounds and distortions indigenous to their products.

This device may simply use a standard variable resistance. One such embodiment is a sliding type resistor to coincide with the pulling or pushing of the strap. However, any type of rheostat or variable resistor could be used through modification to the guitar strap motion. The foregoing may also be achieved by other means such as lasers or other light emiting sensors to create variable resistance of a signal. Accordingly, these means may be utilized in particular embodiments and incorporated into a standardized guitar strap. Further, this instant device not only includes standard resistance means but other means which are commonly used in the market today.

As such, FIG. 1 depicts guitar strap 1 with guitar strap slidable connector 2 as a part thereof. Integral with guitar strap 1 is jacket 3 which houses the variable resistor means of manipulating the electronic signal to a processor. Also shown is processor 4 attached and integral with guitar strap 1. Note power switch 5 in a relative location so the guitar player is capable of either turning power on or off to processor 4.

Figure 2:
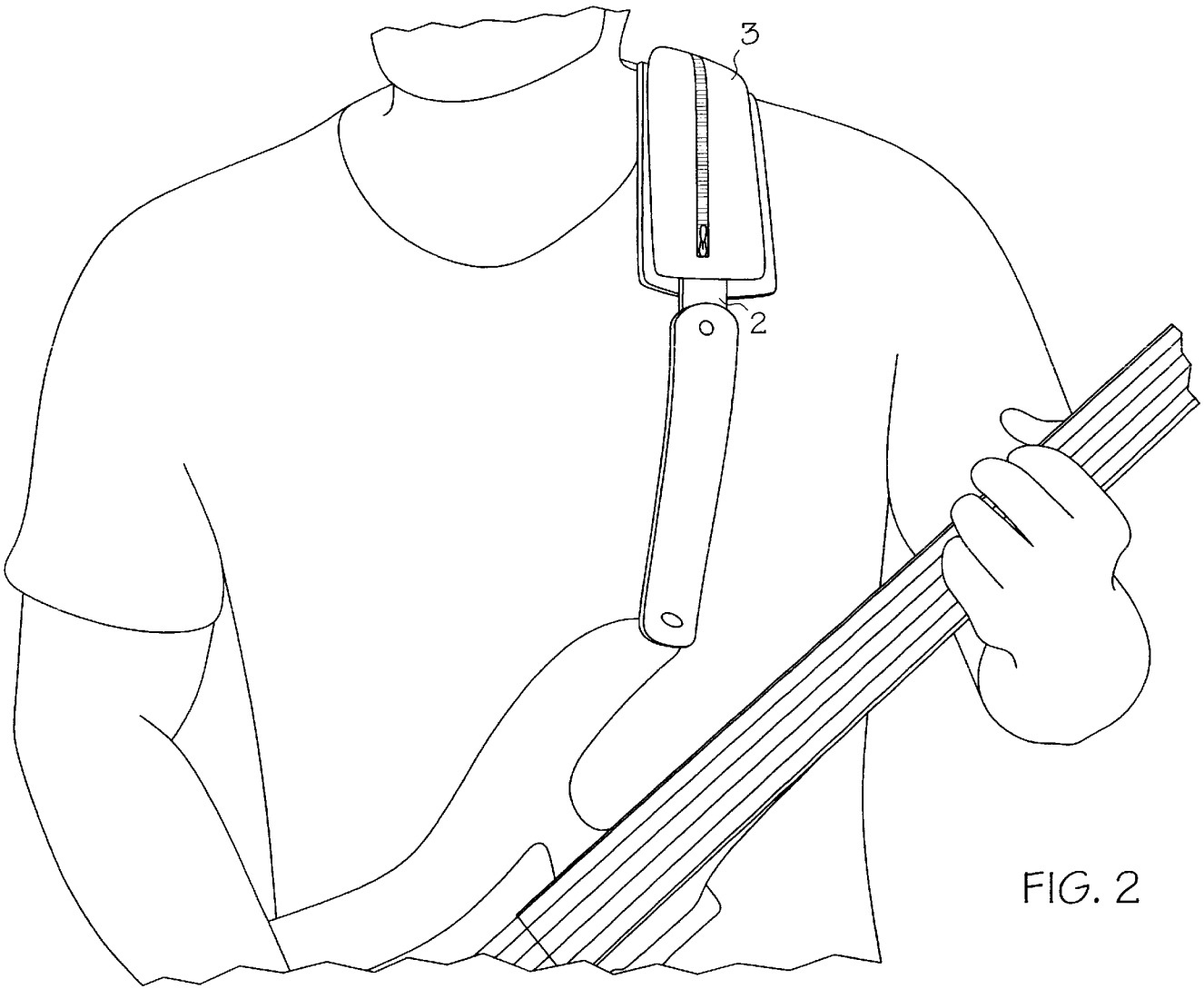
FIG. 2 is a frontal view of the device located within the guitar strap in the upward most or starting position.

FIG. 2 is a frontal view of this particular device. Here, guitar strap 1 is evident in a position where there would be no activation of the oscillating means. Jacket 3 is capable of being seen and it is apparent from this particular drawing that slidable connector 2 inserts through the bottom of jacket 3 so as to be slidable in relationship thereto.

Figure 3:
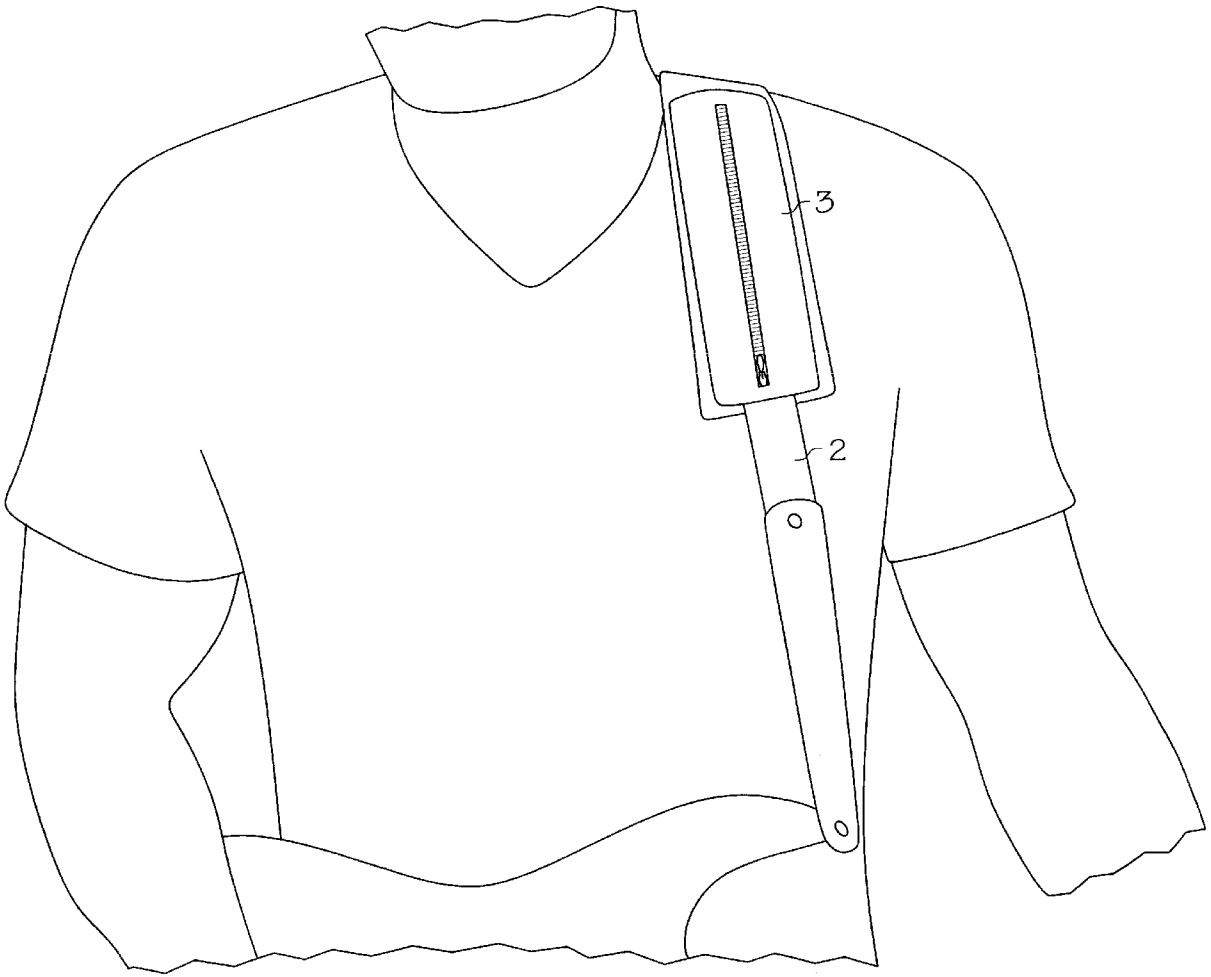
FIG. 3 is a frontal view of the device in a position in its downward most position.

FIG. 3 shows the frontal view of this device. Here, slidable connector 2 is quite evident. This particular view is in the position such that the player would be utilizing a modulation and sound and slidable connector 2 is readily seen as being retracted from jacket 3.

Figure 4:
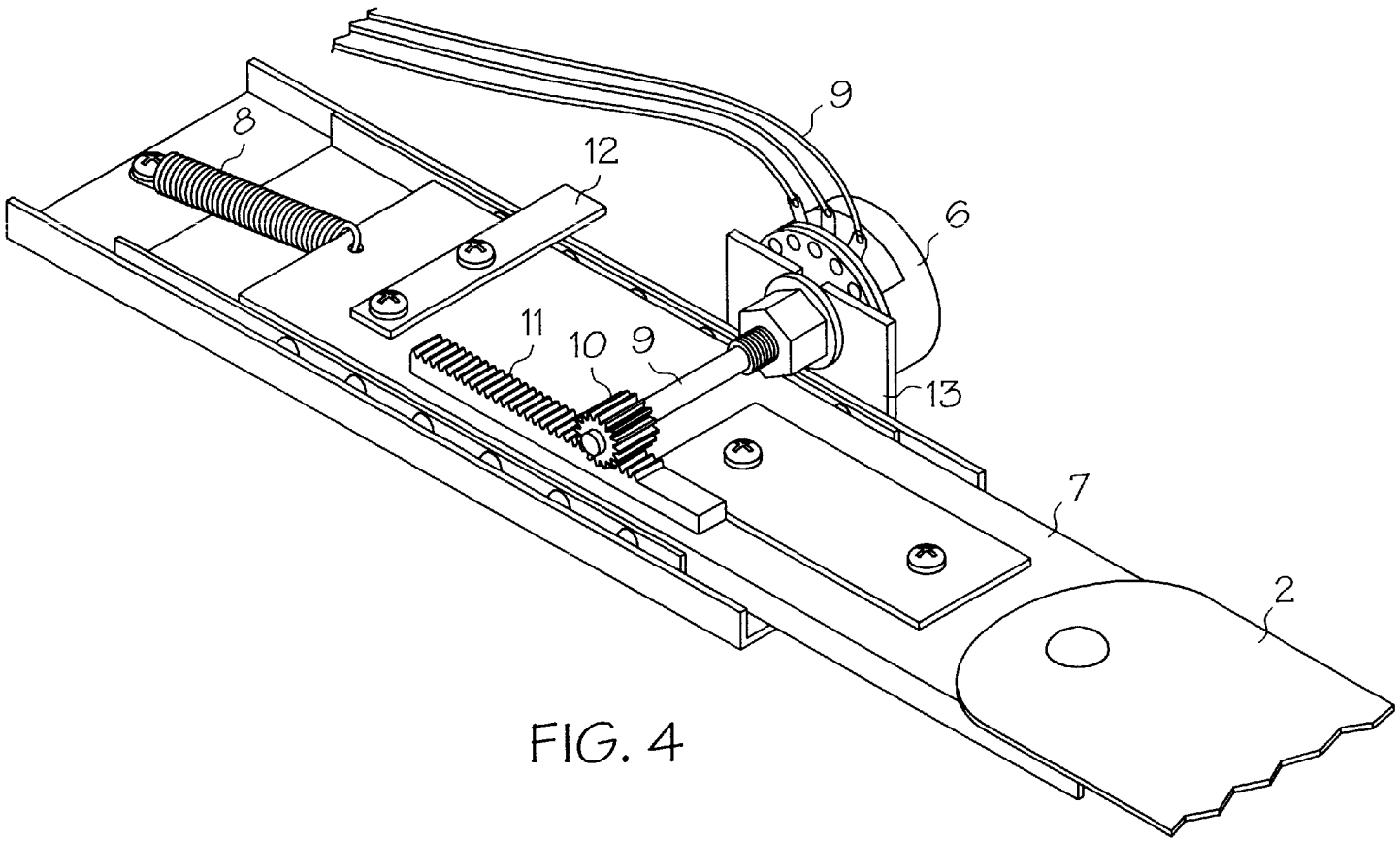
FIG. 4 is a schematic diagram showing the essential elements of the electronic device as located within the guitar strap.

FIG. 4 shows the essential ingredients of the device. Here, slidable connector 2 is apparent as attaching to mounting plate 7. Mounting plate 7 contains a plurality of items necessary in order to operate the device. Initially, mounting plate 7 is in a biased position by spring 8. It is noted spring 8, in its resting position pulls mounting plate 7 towards it such that there is no activation of the modulating device. Also seen in this view is variable resistor 6 mounted on mounting bracket 13 and lead wires 9 traversing therefrom and ultimately covering the length of strap 1 until entry into processor 4. Attached to variable resistor 6 is resistor stem 9 with gear 10 located at distal end thereof. Thereafter, one is capable of seeing gear drive means 11 affixed to mounting plate 7 as described. This Figure also shows stop bar 12 which acts as a mechanism to stop slidable connector 2 from being withdrawn past its point of contact with mounting bracket 13.

In operation, it is clear to see that pulling upon slidable connector 2 results in a lengthening of spring 8. Thereupon, the relationship between gear drives means 11 and gear 10 results in the rotation of gear 10 along the track of gear drive means 11. This, in turn, results in activation of variable resistor 6 through it's range of modulation.

Conversely, should the artist wish to discontinue modulation, pressure is taken off of the guitar and slidable connector 2 coupled with spring 8 results in movement into the initial position of gear 10 along gear drive means 11 and there is no further modulation of the guitar sound.

As recited above, there are various means to accomplish the variable resistance. Many are in the common art and some have been described above. However, the principle and main issue to be addressed is separation of the variable resistance means from the actual electronics of the processor in order to adapt to the guitar player's particular style of play. This is done nicely with the instant device.

What I claim is:

1. A device placed integral with a guitar strap which is capable of modulating the sound emitted by an electronic guitar by transmitting variable electrical signals through a sound processor conducive to modulation of sounds through variable current and comprising:

a. A jacket placed on either the body or guitar neck side of the guitar strap, said jacket containing a mounting plate attached to the guitar strap and biased in its starting position by a spring; and b. A variable resistor with lead wires to the sound processor, the variable resistor attached to the guitar strap by means of a mounting bracket; and c. A resistor stem traversing through the mounting bracket with a gear attached at the end of the resistor stem, said gear in contact with a gear drive means mounted upon the mounting plate intended to rotate the resistor stem; and d. A slideable connector attached to the guitar strap and further attached to the mounting plate at the end opposite the spring whereby movement of a guitar neck or body in an upward or downward motion results in the travelling of the gear upon the gear drive means with corresponding rotation of the resistor stem thereby activating the variable resistor thereby causing sound modulation through the sound processor.

2. The device of claim 1 wherein the variable resistor means is a rheostat capable of creating variable resistance.

* * * * *